United States Patent [19]

McNamara et al.

[11] Patent Number: 4,750,432

[45] Date of Patent: Jun. 14, 1988

[54] EXTENSIBLE TABLE

[75] Inventors: George E. McNamara, Minneapolis; Virgil D. Peterson, Bloomington, both of Minn.

[73] Assignee: Sico Incorporated, Minneapolis, Minn.

[21] Appl. No.: 914,562

[22] Filed: Oct. 2, 1986

Related U.S. Application Data

[63] Continuation-in-part of Ser. No. 795,984, Nov. 7, 1985, abandoned.

[51] Int. Cl.[4] ..... A47B 1/04

[52] U.S. Cl. ..... 108/69; 108/78

[58] Field of Search ..... 108/69, 73, 74, 112, 108/77, 78; 16/362, 364

[56] References Cited

U.S. PATENT DOCUMENTS

| | | | |
|---|---|---|---|
| 2,134,397 | 10/1938 | Clark | 16/362 X |
| 2,227,234 | 12/1940 | Segal | 108/74 |
| 2,358,174 | 9/1944 | McFall | 108/77 |
| 2,631,006 | 3/1953 | Sick | 248/140 X |
| 2,707,663 | 5/1955 | Nickel | 108/6 X |
| 3,020,111 | 2/1962 | Berliner | 108/69 X |
| 3,437,058 | 4/1969 | Bue | 108/112 |
| 4,108,083 | 8/1978 | Espinosa | 108/6 |
| 4,301,744 | 11/1981 | Walter | 108/77 |
| 4,446,796 | 5/1984 | Wilson et al. | 108/69 |

FOREIGN PATENT DOCUMENTS

| | | | |
|---|---|---|---|
| 1915863 | 6/1973 | Fed. Rep. of Germany | 108/78 |
| 1430379 | 1/1966 | France | 108/69 |
| 1045717 | 10/1966 | United Kingdom . | |

*Primary Examiner*—Kenneth J. Dorner
*Assistant Examiner*—José V. Chen
*Attorney, Agent, or Firm*—Merchant, Gould, Smith, Edell, Welter & Schmidt

[57] ABSTRACT

A table is disclosed having extension leaves secured to opposite edges of the table top by hinges. The hinges include a first hinge member which is secured to the leaf and a second hinge member which is connected to the table top and is slidable relative to the table top. The first and second hinge members are pivotally connected to one another by a pivot pin carried by the slidable second hinge member and received within an elongated slot of the first hinge member. A rigid stop is secured to the second hinge member and spaced away from the pivot pin a distance less than a radius from the first end of the slot to the terminal end and a distance less than a radial distance from the second end of the slot to the terminal end.

3 Claims, 6 Drawing Sheets

FIG. 6
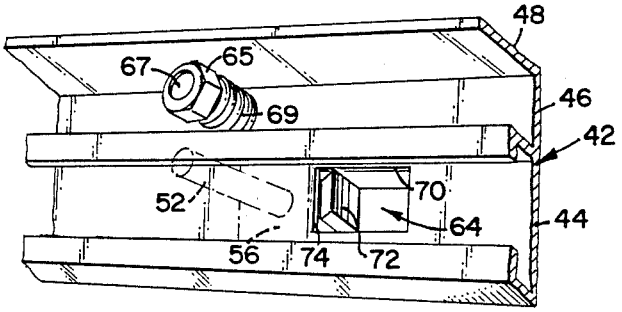
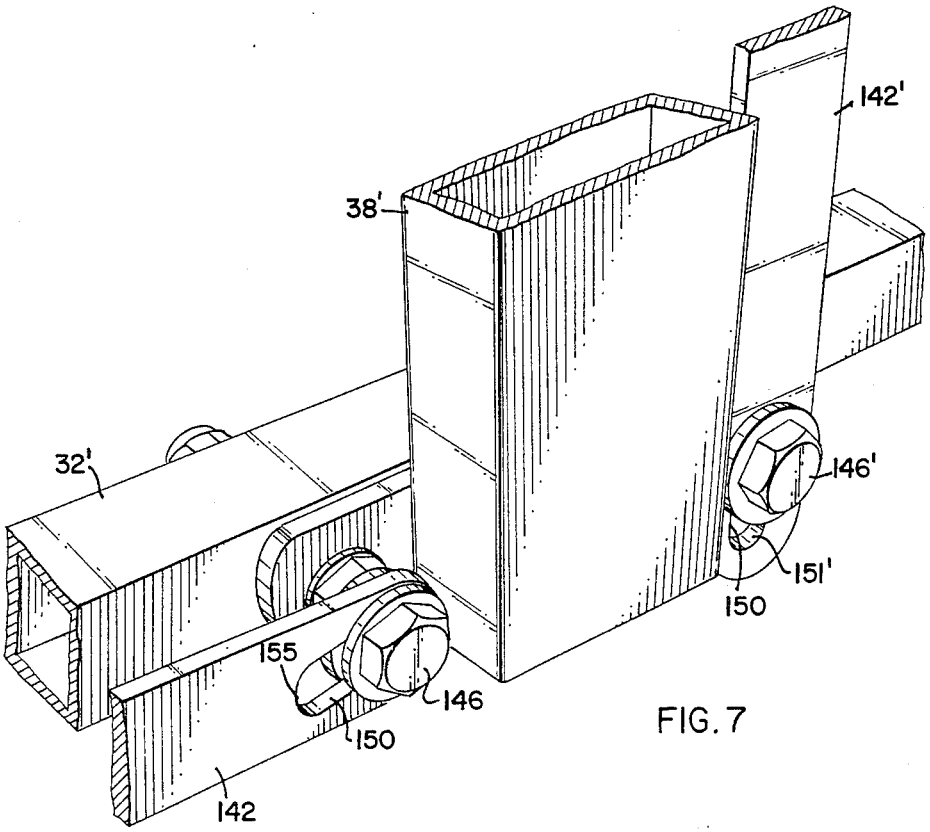
FIG. 7

EXTENSIBLE TABLE

This is a continuation-in-part of application Ser. No. 795,984, filed Nov. 7, 1985 and now abandoned.

BACKGROUND OF THE INVENTION

I. Field of the Invention

This invention pertains to tables having folding leaves and in particular to an improved hinge mechanism for pivotally connecting the leaves to a table top.

II. Description of the Prior Art

In the prior art, tables having folding leaves are well known. Common use of such tables is in the hotel industry which uses tables having leaves which assume one of two or three positions. The leaves may be horizontal and flush with the table top for serving or the leaves may be pivoted to either a down position or an up position for transport through hotel hallways or for storage of the table. Tables with leaves which pivot to a vertical position above the table top are desirable in that during transport of the table through hotel hallways, the table leaves act to contain transported dishes, utensils and food on the table top. In addition to having pivotable leaves, such tables are commonly provided with a table top which pivots on a support between a flat horizontal position and a 90 degree displaced vertical position. Such tilting on a support is desirable for storage of the table when not in use. An example of such a prior art table is shown in commonly assigned U.S. Pat. No. 4,446,796 to Wilson et al. dated May 8, 1984.

While a table such as described in the aforementioned U.S. patent has proven very useful in the industry, it has been discovered that such tables may be subject to certain disadvantages under some circumstances. As disclosed in the aforementioned patent, the table leaves are connected to the table top by a plurality of hinges which include a stationary pivot member which is secured to the table and a slide member which is secured to the leaf. The slide member is slidably movable relative to the pivot member but the two members are urged together by means of an interconnecting spring. When the table leaves are to be moved from a position flush with the table top, the leaf must be pulled away from the table top a predetermined stroke and either pivoted to a down position or a leaf up position. In either event, when the leaf is pulled away from the table top, the hinges are exposed. This can result in undesirable consequences in that during use, such table tops are provided with tablecloths which are commonly white. When the leaves are pulled apart to expose the hinges, the tablecloth can migrate into the hinge area and become soiled. Also, the tablecloth can become pinched when the table leaf is returned to the horizontal position. Another problem associated with such prior art table tops is that when the table is to be moved from the leaf up position to a flush position, the leaf must be moved against the urging of the spring. This can result in cumbersome operation of the table when attempting to move the leaves to a position flush with the table top. Commonly this action takes place in a hotel's guest room when the room service table is being set up in the presence of the hotel guests. At such time, it is very desirable from the standpoint of the hotel to have the operation of the table top be as smooth and graceful as possible to avoid discomforting the hotal guest in any manner. A still further problem of the prior art apparatus is that when the table leaf is moved to the down position, the table leaf extends substantially far from the table top which requires additional space for transport or storage of the table.

SUMMARY OF THE INVENTION

According to a preferred embodiment of the present invention there is provided a table comprising a support and a table top connected to the support. A leaf is provided for the table top with a hinge for connecting the leaf to the top for movement of the leaf from a first position aligned with the top to a second position with the leaf generally normal to the table top. The hinge includes a first member which is secured to the leaf and a second member connected to the table top. The first and second members are pivotally connected and the second hinge member is slidably connected to the table top.

More specifically, according to a preferred embodiment of the present invention, a pair of table leaves are pivotally connected to opposing edges of a table top by a plurality of hinges. The hinges include a first hinge member connected to the leaf and a second hinge member slidably connected to the table top. Opposing sliding hinge members on the table top are slidably received in a channel and connected to one another by a spring. A sliding hinge member and an associated first hinge member are connected by a pivot pin received within an elongated slot of the first hinge member. A stop is provided secured to the second hinge member adjacent the pivot pin and spaced therefrom a distance to permit pivoting of the leaf when the first hinge member is positioned with a first end of the slot adjacent the pin. The stop prevents pivotal motion when the first hinge member is positioned with a second end of the slot adjacent pin.

BRIEF DESCRIPTION OF THE DRAWING

FIG. 6 is a perspective view of a channel with latch member protruding through the channel;

FIG. 7 is a perspective view of pivot and lock mechanisms for the table shelves;

DESCRIPTION OF THE PREFERRED EMBODIMENT

Figure 1:
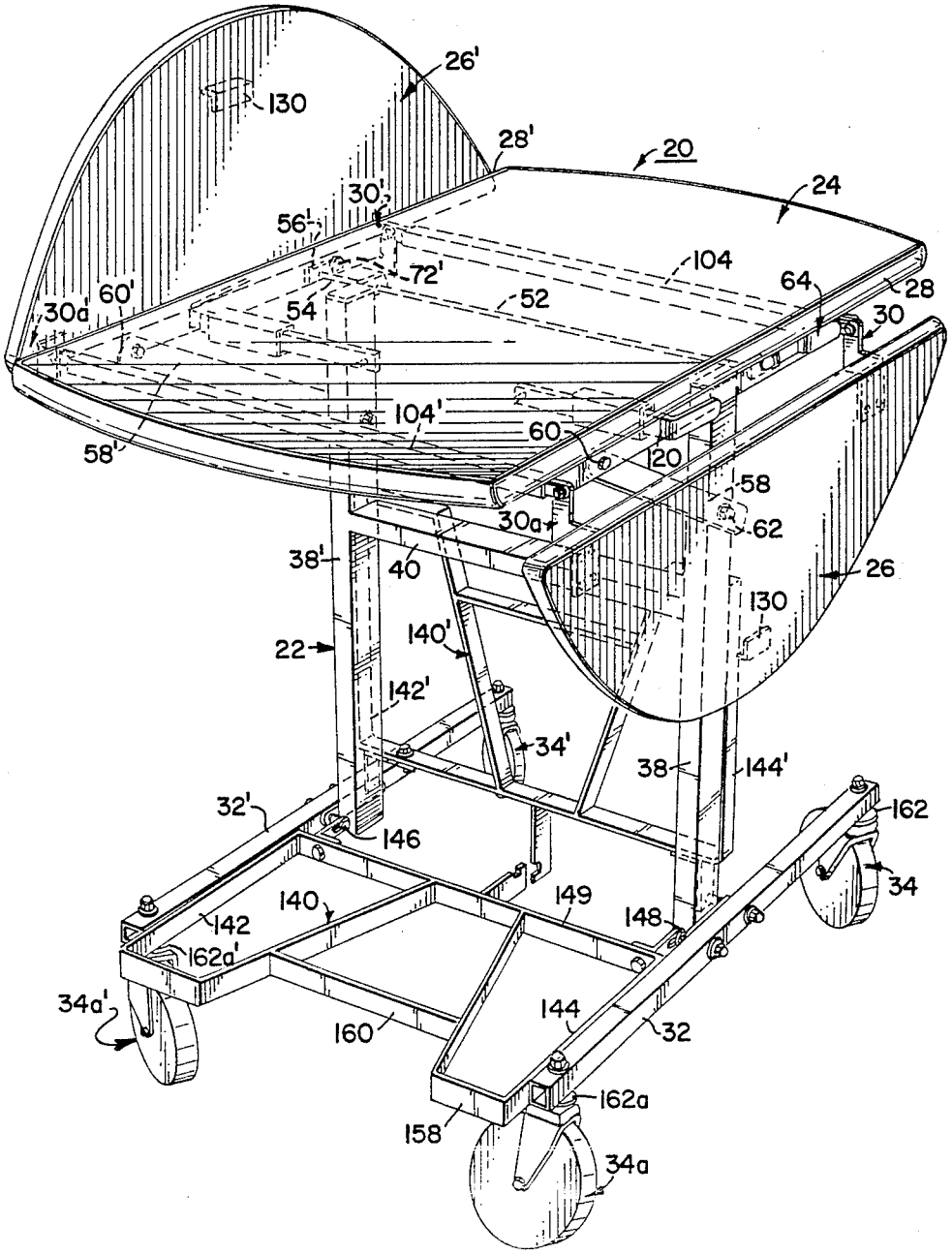
FIG. 1 is a view in perspective of a room service table incorporating the present invention.

Referring to the drawings, a table 20 is shown comprising a support 22 and a table top 24 pivotally secured to the support 22 as will be more fully described. A pair of extension leaves 26 and 26' are secured to opposite edges 28 and 28' by hinges 30, **30*a*, 30' and 30*a'***.

Support 22 includes a pair of spaced apart parallel longitudinal base members 32 and 32' which are provided with casters 34, 34a, 34' and 34a' which place the base members 32 and 32' in a common horizontal plane above a horizontal surface 36. The support 22 further includes a pair of vertical posts 38 and 38' secured to and extending perpendicularly upwardly away from base members 32 and 32', respectively. Posts 38, 38' are interconnected by horizontal cross member 40.

Figure 4:
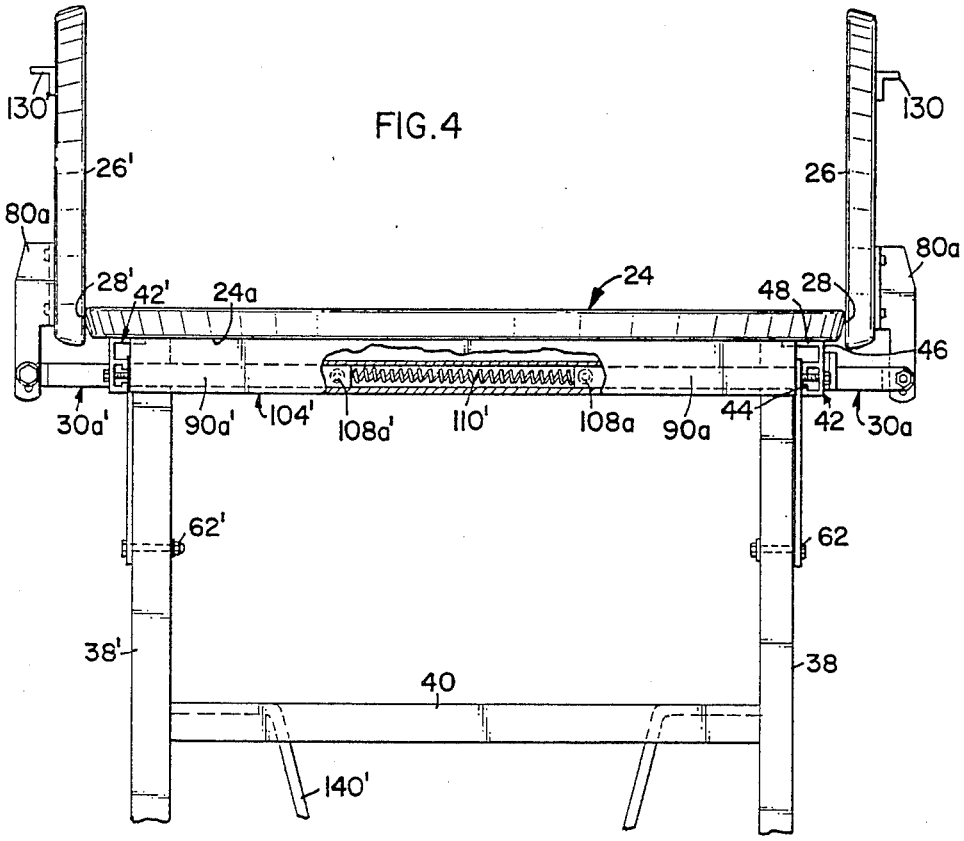
FIG. 4 is a side elevation view of an end of a table with the top in a use position and with table leaves in vertical positions above the top.
Figure 5:
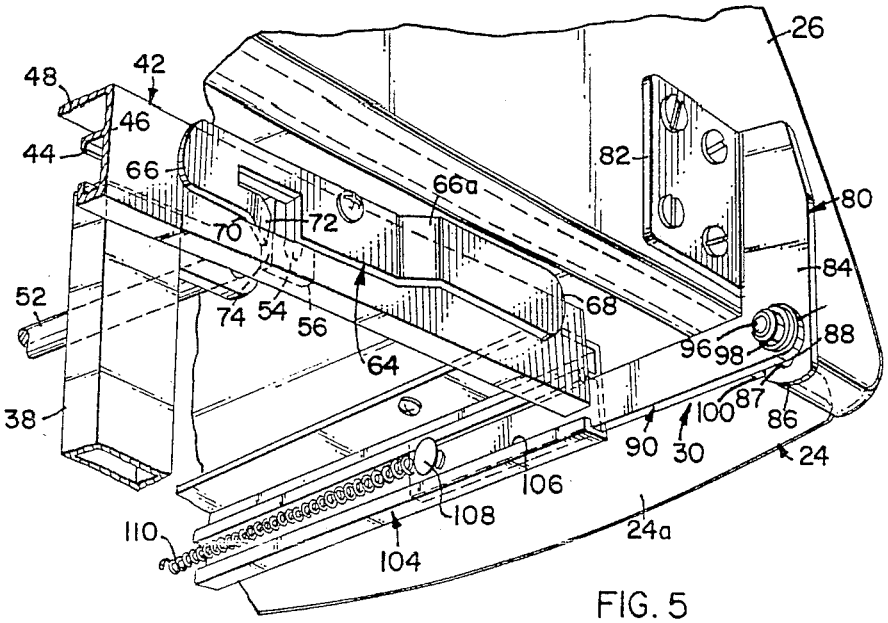
FIG. 5 is an enlarged perspective view of a hinge mechanism.

A bottom surface 24a of table top 24 is provided with a pair of spaced apart parallel channels 42 and 42' adjacent and parallel to edges 28 and 28', respectively. The channels 42 and 42' are spaced apart a distance greater than a spacing of posts 38 and 38'. As shown in FIGS. 4 and 5, channels 42 and 42' are identical and a description of channel 42 (as shown in FIGS. 4 and 6) will suffice as a description of channel 42'. Channel 42 comprises an extrusion having a U-shaped channel portion 44. A vertical spacer portion 46 connects channel portion 44 to a horizontal mounting flange 48 which is secured to the bottom surface 24a by any suitable fashion such as by a plurality of screws. Channels 42 and 42' are secured to bottom surface 24a with their respective channel portions 44 and 44' facing one another.

Figure 2:
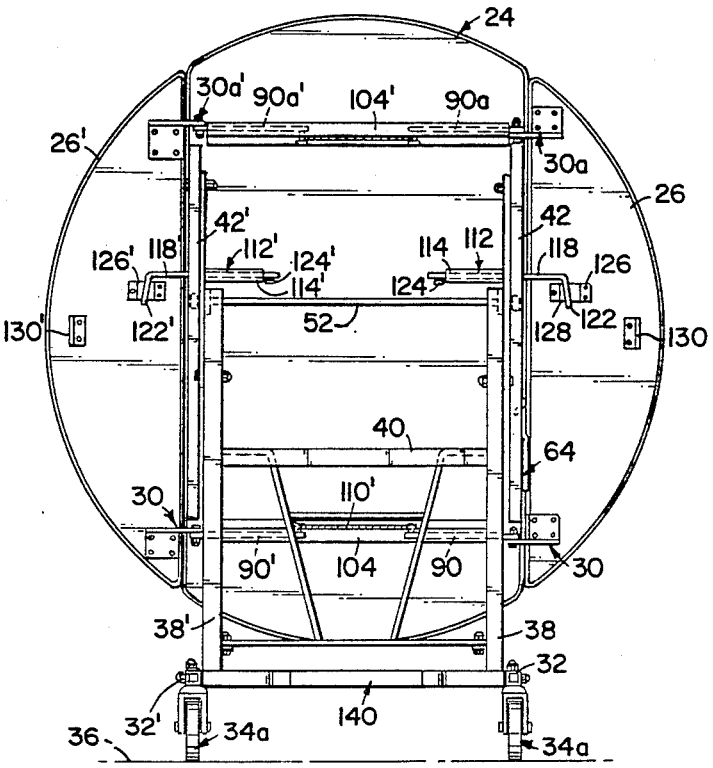
FIG. 2 is a view in elevation of a room service table incorporating the invention with its top tilted to a storage position.

Shown in FIGS. 1, 2 and 5, a rod 52 is secured to the top of the posts 38 and 38'. The rod 52 is sized such that its free ends 54 and 54' extend beyond posts 38 and 38' and into channel portions 44 and 44', all respectively. The free ends 54 and 54' are each provided with plastic slides 56 and 56' which are sized to be slidably received within channel portions 44 and 44', again all respectively. A pair of support arms 58 and 58' are pivotally connected to channels 42 and 42' at 60 and 60' and also pivotally connected to posts 38 and 38' at 62 and 62'.

As noted, slides 56, 56' are slidably received within channel portions 44, 44'. Also, slides 56, 56' are freely rotatable on free ends 54, 54' as channel portion 44, 44' pivot relative to rod 52 (that is, slide 56, 56' are captured within channel portions 44, 44' and are urged to rotate on free ends 54, 54' as channel portions 44, 44' are pivoted). Accordingly, table top 24 is pivotably secured to the support 22. Namely, the table top 24 may be rotated from a horizontal position (such as that shown in FIG. 3) to a vertical position (such as that shown in FIG. 2) with the axis of rotation being coaxial with rod 52. When the top is pivoted in the desired direction (e.g. counterclockwise in the view of FIG. 3 to pivot to a vertical position), the slides 56, 56' rotate on free ends 54, 54'. As the slides 56, 56' rotate, the slides 56, 56' and channel portions 44, 44' move relative to one another. The combined motion of the relative movement of slides and channel portions and the rotation of the slides results in the pivotal movement of the table top about rod 52. The table top 24 is restrained from unrestricted movement by arms 58 and 58'. For example, arms 58, 58' restrict the table top 24 from left to right motion in the view of FIG. 3 when the top 24 is in the horizontal position.

When in the down position (conveniently referred to as the "out of service" position) (as shown in FIG. 2), the bottom surface 24a of the table top 24 opposes posts 38 and 38'. The opposition and the weight of the table hold the table top 24 in the vertical position. To pivot top 24 to the up or horizontal position (conveniently referred to as the "in service" position), the top 24 is pivoted about rod 52 (clockwise in the view of FIG. 3) to the "in service" position. As the table top 24 moves to the in service position, the table top 24 moves relative to slide 56, 56' which are sliding within channel portions 44, 44'. At the in service position, sliding motion is stopped by reason of slide 56' abutting a stop 72'. Stop 72' is disposed within channel portion 44' at a predetermined position for stop 72' to block further movement of slide 56' within channel 44 past the desired horizontal position.

As shown in FIGS. 5 and 6, a latch 64 is secured to channel 42. The latch includes a latching surface 66 which is generally abutting an outer surface of channel 42. An outwardly projecting segment 66a connects the latch surface 66 with a handle portion 68 which is spaced away from the channel outer surface. The latch 64 is pivotally connected to channel 42 by a bolt 67 passing through channel 42 and which receives a spring 69 surrounding bolt 67 between channel 42 and retaining nut 65. Opposing latching surface 66 is broken away to provide opening 70 extending through channel portion 44. The opening 70 is positioned on channel portion 44 such that the opening 70 will permit communication through the channel 42 and expose plastic slide 56 when the table is pivoted to the horizontal position as shown in FIG. 5. The latch surface 66 is provided with a latching element 72 which is sized to pass through hole 70 and engage a latching edge 74 of plastic slide 56. When handle portion 66 is engaged and urged toward channel 42, the handle pivots at the bolt 67 with the latching element 72 moving out of latching engagement with latching edge 74. When disengaged, the table top 20 can be tilted to a vertical storage position.

In FIG. 6, the rod 52 and slide 56 are shown in phantom lines to improve the clarity of the Figure.

Figure 11:
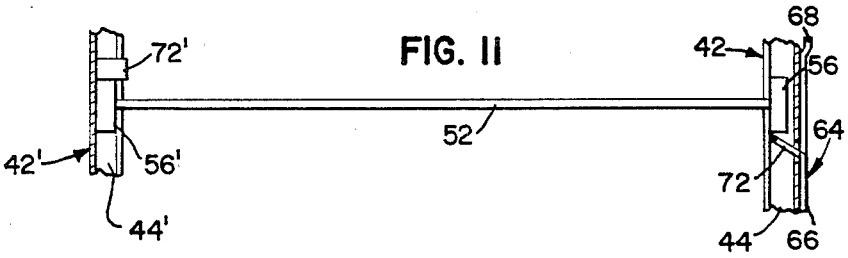
FIG. 11 is a top plan view taken in section showing slides of the present invention in a table top locked position.

Stop 72' and latching element 72 are disposed to capture the slides 56' and 56 between stop 72' and element 72 when the table top is in the horizontal position. The cooperation of latching element 72 and stop 72' to lock the table top 24 in the horizontal position is best shown in FIG. 11. Stop 72' prohibits further pivotal movement of the table top in a direction away from the down position. Latch element 72 prohibits pivotal movement of table top 24 back to the down position unless handle 66 is engaged and urged toward channel 42.

Extension leaves 26 and 26' are attached by hinges 30, 30a, 30' and 30a', each of which are identical and the description of hinge 30 will suffice as a description of the others. Like parts of each of the hinges are numbered identically except for the addition of the letter "a" or an apostrophe to identify association with a particular hinge. Shown best in FIG. 5 and FIGS. 8–10, hinge 30 (or hinge 30' in FIGS. 8 through 10) includes a first hinge member 80 having a mounting plate 82 to be secured to a bottom surface of a leaf. A tongue 84 extends perpendicularly away from the mounting plate 82 and extends longitudinally beyond the plate 82 to a rounded free end 86. An elongated slot 88 is provided extending through tongue 84 and having a longitudinal direction parallel with mounting plate 82. A first end 87 of the slot 88 which is spaced the furthest distance from mounting plate 82 is provided coincident with a center point of a circle which includes the contour around free end 86.

A second hinge member 90 for connection to the bottom surface 24a of the table top 24 (as will be described) is provided. Second hinge member 90 is an elongated rectangular rod sized to be slidably received within a channel having dimensions such as that of channel portion 44'. The second member 90 has a pivot end 92 having a hole formed therethrough for receiving a pivot pin 96 having an axis generally parallel to the edge 28 of the table top and perpendicular to the tongue 84 of first hinge member 80. The pin 96 extends through the hole and elongated slot 88 pivotally joining the first hinge member 80 and second hinge member 90. The pin is secured in place by a nut and washer 98. A stop comprising a steel bar 100 is secured to the second hinge member 90 on a side of pivot pin 96 opposite the pivot end 92. The stop is aligned on second member 90 to have a vertical stop surface 102 when the second hinge member 90 is secured to the table top as will be described. The stop surface is spaced from pivot pin 96 a distance only slightly greater than a radius of the rounded free end 86 of first hinge member 80. The distance from the pivot pin 96 to the stop surface 102 is less than a radial distance from the second end 89 of elongated slot 88 to an end 85 of the tongue 84.

A pair of spaced apart parallel channels 104 and 104' are provided extending generally perpendicular to edges 28 and 28'. The channels 104 and 104' extend almost the entire length of the bottom surface of table top 24. The hinges are aligned on the leaves 26 and 26' such that hinges 30 and **30*a* are provided with their first hinge members 80 and 80*a* secured to leaf 26. Similarly, hinges 30' and 30*a'* are mounted with their respective first hinge members 80' and 80*a'* secured to extension leaf 26'. The hinges are secured to their respective leaves such that second hinge member 90 opposes and is aligned with second hinge member 90'. Likewise, second hinge member 90*a* is opposed and aligned with second hinge member 90*a'***.

The channels 104 and 104' are identical in construction with channel 42 and each provide for a channel portion 106 and 106' respectively. The second hinge members 90, **90*a*, 90' and 90*a'* are sized to be slidably received within the channel portions of channels 104 and 104' such that second hinge members 90 and 90' are slideably received in opposite ends of channel portion 106 of channel 104. Likewise, second hinge members 90*a* and 90*a'* are slidably received at opposite ends of channel portion 106' of channel 104'. Opposing ends of the second hinge members 90, 90*a*, 90' and 90*a'* are provided with posts 108, 108*a*, 108' and 108*a'*, respectively. Springs 110 and 110' are provided connecting posts 108 and 108' and posts 108*a* and 108*a'***, respectively, urging their attached second hinge members toward one another.

Figure 9:
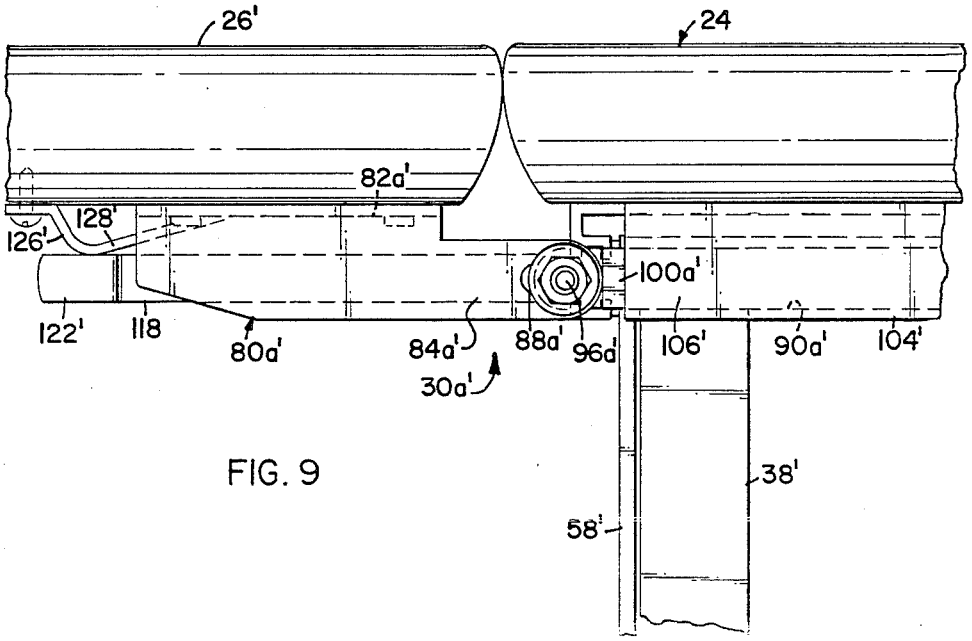

As shown best in FIG. 9, channel portions 106 and 106' are spaced away from the bottom surface of the table top the same distance as the elongated slot 88 of the first hinge member 80 is spaced from the bottom of the extension leaves such that when the leaves are in the horizontal position flush with the table top, opposing edges of the table top and leaves are aligned and abutting. Also, it will be noted from the figures that the opposing edges of the table tops and the leaves are rounded at the upper surface of the leaves and table and beveled inwardly.

Best shown in FIG. 2, a pair of leaf supports 112 and 112' are provided for supporting each of leaves 26 and 26', respectively, in a position with the extension leaves aligned with the table top 24. The leaf supports are identical and a description of leaf support 112 will suffice as a description of leaf support 112'.

Leaf support 112 includes a channel member 114 which is an extrusion identical in cross section with channel 42. The channel 114 is aligned with its channel portion extending generally transverse to the opposing edges of the leaf 26 and the table top. The leaf support 112 includes a rod 118 sized to be slidably received within the channel 114 and extending through an opening 120 formed through channel 42. A free end of the support rod 118 is provided with a handle 122 which is inwardly turned from support rod 118 at a suitable angle therewith approximately 90 degrees, or any other suitable angle. The support rod 118 is slidable within channel 114 between a first position with the handle 122 beneath the table top 24 to permit free pivotal movement of the leaf 26. The support rod 118 is extensible to a second position with the handle 122 disposed beneath the leaf 26. Accurate extendible positioning of the support rod 118 is provided by a stop 124 secured to an inner end of the support rod 118 which abuts the channel 114 when the support rod 118 has been extracted a desired full stroke. In the fully extended position, the handle 122 is aligned opposing a spacer 126 secured to a bottom surface of the leaf 26. The spacer has a surface opposing the handle 122 spaced from the leaf 26 a distance sufficient for the spacer to support the leaf on the handle 122 with the leaf 26 flush with the table top 24. A spacer 126 is provided with a sloping surface 128 opposing the channel 42. Each of leaves 26 and 26' is provided with an operator engagable handle 130 and 130' secured on an under surface thereof centrally located on an outer edge of the bottoms of extension leaves 26 and 26', respectively.

The support 22 is provided with a pair of shelves 140 and 140' disposed on opposite sides of posts 38 and 38'. Shown best in FIGS. 1 and 7, the shelves 140 and 140' are identical and a description of one will suffice as a description of the other. Shelf 140 includes a pair of parallel spaced apart side walls 142 and 144 which are pivotally secured to base members 32 and 32' by pivot pins 146 and 148. As shown, pivot pins 146 and 148 are received within elongated slots 150 and 152 of side walls 142 and 144, respectively. The pins 146 and 148 are spaced from vertical posts 38 and 38' a distance sufficient such that the side walls 142 and 144 are freely pivotable about pins 146 and 148 when the pins engage first ends 151 and 153 of elongated slots 150 and 152. When the pivot pins 146 and 148 engage the second ends 155 and 157 of the elongated slots 150 and 152, the side walls 142 and 144 abut vertical posts 38 and 38' thereby preventing pivotal movement of the side walls. The side walls are connected by a cross member 149 and a second cross member 158 having a recess 160 centrally located on cross member 158. Horizontal flanges 162 of the casters provide support for the side walls 142 and 144 when the shells are rotated to the down position.

OPERATION

The benefits of the present invention will become apparent by reason of an explanation of the operation of the apparatus of the preferred embodiment.

Figure 3:
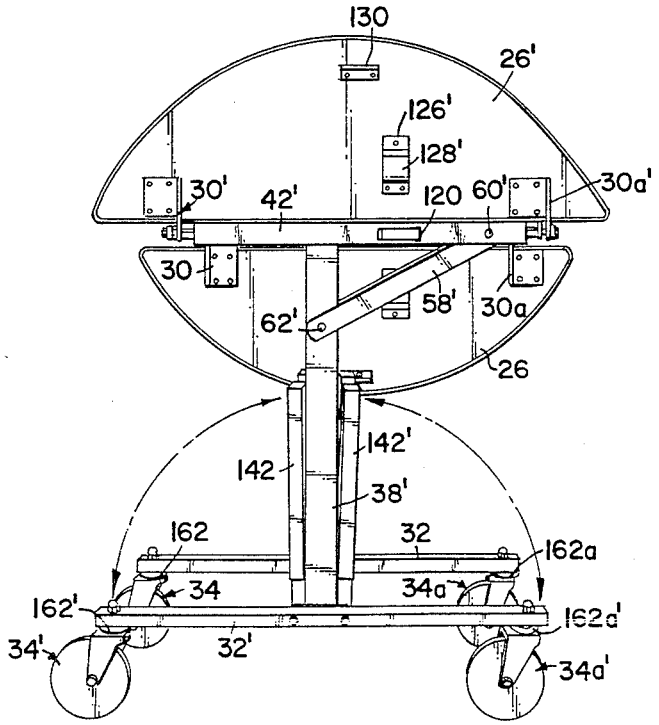
FIG. 3 is a view taken in elevation of a room service table incorporating the invention with the table top tilted to a use position.

When the table is in its position to be used in a hotel room, the table leaves 26 and 26' are fully extended and flush with the table top 24. Shelves 140 and 140' may be tilted to either an up or down position as preferred and as indicated by the arrows of FIG. 3. When rotating the shelves from an up position to a down position, the cross member 158 is engaged and lifted until the pivot pins 146 engage the first ends 151 and 153 of the slots 150 and 152 at which point the shelves may be pivoted to the down position with the side walls 142 engaging flanges 162. It should be pointed out that in transport of the table, the shelves may remain in the down position with the recess 160 providing adequate clearance for the ankles and feet of an operator pushing the table through a hallway.

When the table is in a position to be used in a room, the leaves are flush with the table top and the tongue 84 of the first hinge member 80 extends in a horizontal plane generally coincident with the second hinge member 90. In this position, the spring 110 urges opposing hinge members 90 together with pivot pins 96 disposed beneath the table top 24. Opposing rounded edges of the table top and the leaves abut one another. The handle portion 122 of support rod 118 engages spacer 126 maintaining the leaves in proper alignment with the table top. Also, the table top is tilted to its horizontal position with latching element 72 of latch 64 engaging the latching edge 74 of the plastic slide 56 in locking engagement. FIG. 9 shows hinge 30*a*′ when the leaf 26′ is in an extended position flush with the table top 24.

Figure 10:
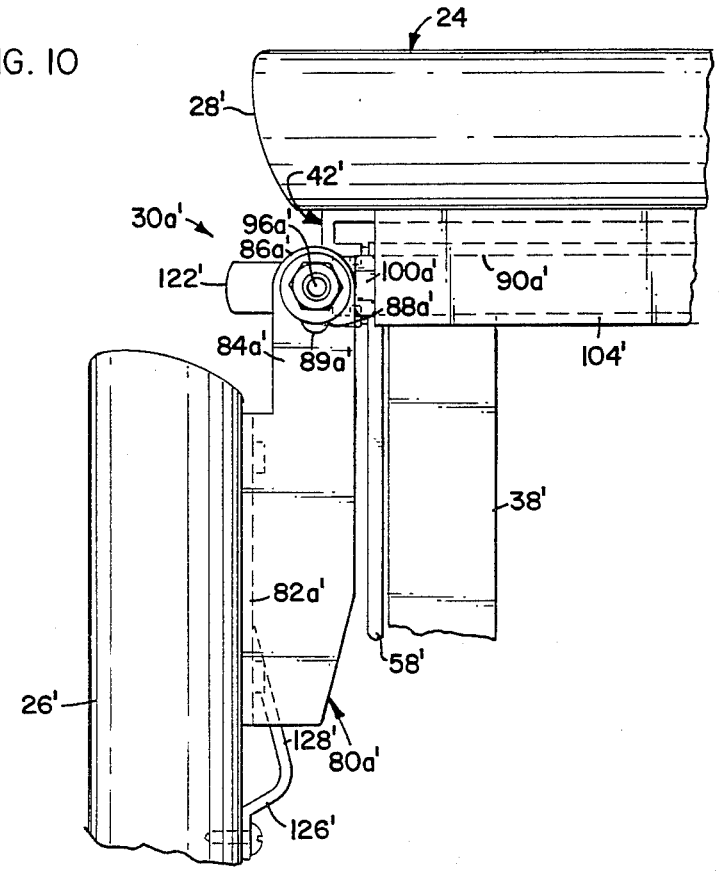

From the position described above, the leaves may be moved to either an up position or a down position. To move the leaf 26′ to a down position, for example as shown in FIG. 10, an operator engages the handle 130′ of the leaf with one hand and with another hand engages the handle 122′ of the support 112′ pushing the support rod 118′ to a position with the handle 122′ beneath the table top 24. Gravity causes the now unsupported leaf 26′ to pivot about pins 96′ and 96*a*′ with the leaf 26′ moving to a position generally vertical with its edge disposed beneath the edge 28′ of the table top since the pivot point is beneath the table top. In such positions, the sliding hinge members 90′ and 90*a*′ are fully received within channels 104 and 104′ such that the stops 100′ and 100*a*′ abut outer surfaces of the channels.

Figure 8:
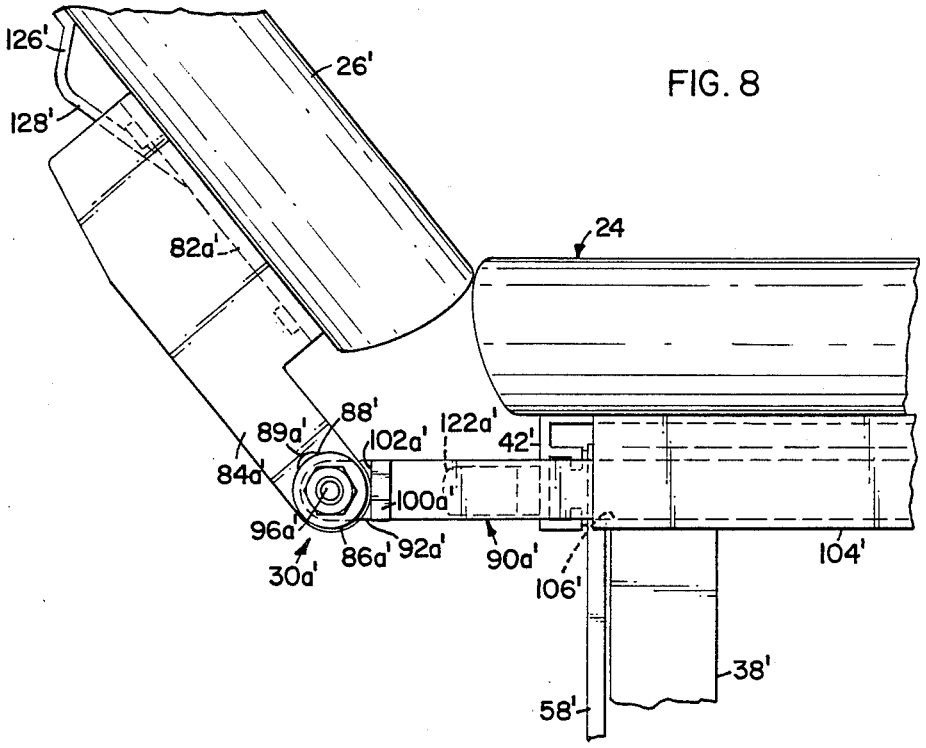
FIGS. 8 through 10 are side elevation views showing in sequence the movement of a leaf from a vertical position above the table top to a vertical position beneath the table top.

When the leaf is to be moved to a position with the leaf generally vertical and above the table top (as shown in FIG. 8 where the leaf 26′ is approaching vertical), the operator engages the leaf handle 130′ and pivots the leaf about pivot pins 96′ and 96*a*′. As the leaf 26′ approaches a generally horizontal position, the leaf edge abuts the opposing rounded edge 28′ of the table top and continues to pivot with opposing rounded edges rolling over one another. In this manner, the leaf and table top edges become part of the hinge mechanism. As the table leaf 26′ continues to move to a generally vertical position, the leaf 26 pivots at the opposing edges with the tongues 84′ and 84*a*′ drawing the sliding hinge members 90′ and 90*a*′ outwardly from channels 104 and 104′. The sliding movement of the hinge members 90′ and 90*a*′ is accommodated by the springs 110 and 110′. When the leaf is vertical, the sliding members 90′ and 90*a*′ are in their fully extended position and the elongated slots 88′ and 88*a*′ of the tongues 84′ and 84*a*′ are vertical. FIG. 5 shows hinge 30 in fully vertical position above table top 24. At this point as shown in FIG. 5, the tongues and a leaf drop vertically until the pins 96 and 96*a* abut the second ends 89 of the slots 88 with the edge of the leaf 26 now disposed lower than the opposing edge 29 of the table top 24. In this position, the stops 100 and 100*a* engage the tongues preventing further pivotable movement of the hinge members. To move the leaf 26 back to a horizontal position, the operator engages the leaf handle 130 and lifts the entire leaf 26 until the tongues have moved such that the first ends of the slots 88 and 88*a* engage the pins 96 and 96*a* at which point the spacing between the pivot pins and the stops 100 and 100*a* is sufficient to permit the rounded ends of the tongues to pivot. As the operator pivots the leaf back toward the horizontal position, opposing edges of the leaf and the table roll against one another and the sliding members 90 and 90*a* 90 of the hinges are urged back into the channels 104 and 104′ by the springs 110 and 110′.

If it is desired to tilt the table top from the horizontal position to a generally vertical position, an operator engages the handle portion 68 of the latch 64 and urges the handle portion 68 towards the channel 42. Due to the pivot attachment of the latch, the latching element 72 is urged out of hole 70 whereby channel portion 44 and plastic slide 56 are freely slidable relative to one another.

It can be seen the present invention provides numerous advantages over the prior art. First, to move the leaves from a vertical position above the table to a position flush with the table, an operator need only lift against the weight of the table top and need not lift against the additional force imposed by a spring as was required in the prior art apparatus. The construction of the table of the present invention permits relatively easy and smooth operation of the extensible leaves in a guest room to permit a graceful and non-disruptive set-up of a room service table. Furthermore, since the leaves move from the vertical position above the table top to a flush horizontal position with opposing edges of the table top and leaves providing the pivot point for the pivotal action, the hinge mechanism are not exposed during this operation which avoids the possibility of soiling of the tablecloth as well as avoiding the need for exposing the unsightly hinge apparatus to hotel room guests. Also, when pivoted to the down position, the leaves are more compact than in the prior art which facilitates movement through narrow high traffic hotel hallways and also reduces space requirements during storage of the table. Finally, the apparatus is economically constructed since all channel members may be cut from the same extrusions.

From the foregoing, it can be seen how the present invention provides advantages not heretofore enjoyed by the prior art. While the foregoing invention has been described by means of a preferred embodiment, it will be appreciated that the invention is not intended to be limited by the specifics of the preferred embodiment and shall include such modifications and equivalents as will appear to those skilled in the art. Accordingly, the scope of the present invention is intended to be limited only by the scope of the claims as are appended hereto.

What is claimed is:

1. A table comprising:

a support (22);

a table top (24);

means for connecting said table top to said support with said top generally horizontal;

a leaf (26) for said table top;

hinge means for hinging said leaf (26) to said table top (24) with said leaf moveable between a first position generally aligned with said table top (24) and a second position extending generally upwardly from said table top, said hinge means including a first hinge member (80) secured to said leaf (26) and a second hinge member (90), slidable connecting means (110, 104) for slidably connecting said second hinge member (90) to said table top (14), pivot means for pivotably connecting said first hinge member (80) and said second hinge member (90), said pivot means including a pivot pin (96) secured to said second hinge member (90) and a slot (88) formed in said first hinge member (80) and extending between a first end and a second end (89), said slot (88) sized to slidably and rotatably receive said pivot pin (96) with said pivot pin (96) disposed adjacent said second end (89) of siad slot (88) when said leaf (26) is in said second position; means (100) carried on said hinge means for locking said leaf (26) in said second position including means (102) for blocking pivotal movement of said pivot pin (96) within said slot (88) when said pin (96) is adjacent said second end (89) of said slot and permitting unobstructed sliding movement of said pin toward said first end of said slot (88) with said pin rotatably within said slot (88) at said first end;

said slidable connecting means including a bracket fixedly secured to said table top, said second hinge member having means cooperating with said bracket for said second hinge member to be slidably received within said bracket, means for urging said second hinge member to slide within said bracket to a position with said pin adjustment said first end of said slot; and said table top and said leaf present opposing edges connected by said hinge means; said edges having opposing generally convex surfaces disposed in abutting relation whereby said leaf edge surfaces pivot on said table top edge surface and said second hinge member slides on said table top as said leaf is moved from said first position to said second position.

2. A table comprising:

a support (22);

a table top (24);

means for connecting said table top to said support with said top generally horizontal;

a leaf (26) for said table top;

hinge means for hinging said leaf (26) to said table top (24) with said leaf moveable between a first position generally aligned with said table top (24) and a second position extending generally upwardly from said table top, said hinge means including a first hinge member (80) secured to said leaf (26) and a second hinge member (90), slidable connecting means (110, 104) for slidably connecting said second hinge member (90) to said table top (24), pivot means for pivotably connecting said first hinge member (80) and said second hinge member (90), said pivot means including a pivot pin (96) secured to said second hinge member (90) and a slot (88) formed in said first hinge member (80) and extending between a first end and a second end (89), said slot (88) sized to slidably and rotatably receive said pivot pin (96) with said pivot pin (96) disposed adjacent said second end (89) of said slot (88) when sid leaf (26) is in said second position; means (100) carried on said hinge means for locking said leaf (26) in said second position including means (102) for blocking pivotal movement of said pivot pin (96) within said slot (88) when said pin (96) is adjacent said second end (89) of said slot and permitting unobstructed sliding movement of said pin toward said first end of said slot (88) with said pin rotatably within said slot (88) at said first end;

said slidable connecting means including a bracket fixedly secured to said table top, said second hinge member having means cooperating with said bracket for said second hinge member to be slidably received within said bracket, means for urging said second hinge member to slide within said bracket to a position with said pin adjacent said first end of said slot; and said table is provided with two leaves on opposite sides of said table top and hinged to said table top with hinge means having second hinge members slidably connected to said table top; second hinge members of the first leaf aligned with second hinge members of a second leaf in a plane coincident with sliding movement of said second hinge members and spring means connecting said opposing sliding members.

3. A table comprising:

a support;

a table top;

first and second extension leaves for opposing sides of said table top;

hinge means for pivotally connecting each of said first and second leaves to said table top, said hinge means including cooperating pairs of sliding hinge members and stationary hinge members, at least one of said cooperating pairs connecting each of said leaves to said table top, said stationary hinge members fixedly secured to said leaves and having tongues with elongated slots therein, said slots hvaing longitudinal dimensions extending between first and second slot ends;

said sliding hinge members each having a pivot pin connected thereto;

slidable connecting means for connecting said sliding hinge members to said table top with said pivot pins slidable between first and second positions, said pivot pins in said first position being disposed beneath said table top, said pins in said second position being disposed spaced from an edge of said table top, said slidable connecting means including a bracket fixedly secured to said table top, said sliding hinge members including means cooperating with said bracket for said sliding hinge members to be slidably received within said bracket, means for urging said sliding hinge members to slide within said bracket to a position with said pivot pins in said first position;

said pins sized to be slidably and rotatably received within said slots; said pins slidable between said first and second ends of said slots and with said pins adjacent said second ends when said leaves are pivoted to a position extending generally perpendicularly upwardly from said table top; rigid stop means secured to said sliding hinge members and disposed to abut said stationary hinge members and block relative rotation between said pins and stationary hinge members when said pins are adjacent said second ends of said slots; and means for pivotally mounting said table top on said support comprising horizontal spaced-apart stationary slide elements supported by said support; a pair of channel members defining channels to receive said slide elements; said channels supported on said table and generally normal to said axis; stop means for blocking pivotal movement in a first direction when said table top is pivoted to a generally horizontal position; latch means for releasably blocking pivotal movement in a second direction and locking said table in said horizontal position comprising a latch having a latching element aligned to engage one of said slide elements in locking engagement when said table is in said horizontal position and a handle member connected to said latch member to urge said latch member out of locking engagement.

* * * * *